United States Patent [19]

Luborsky et al.

[11] 4,217,135

[45] Aug. 12, 1980

[54] IRON-BORON-SILICON TERNARY AMORPHOUS ALLOYS

[75] Inventors: Fred E. Luborsky, Schenectady; John L. Walter, Scotia, both of N.Y.

[73] Assignee: General Electric Company, Schenectady, N.Y.

[21] Appl. No.: 964,621

[22] Filed: Nov. 29, 1978

Related U.S. Application Data

[63] Continuation-in-part of Ser. No. 36,197, May 4, 1979, and Ser. No. 898,482, Apr. 20, 1978, abandoned.

[51] Int. Cl.[2] ..... C22C 1/00; C22C 31/00; C22C 37/00; C22C 19/07

[52] U.S. Cl. ..... 75/123 L; 75/123 B

[58] Field of Search ..... 75/123 B, 123 L

[56] References Cited

U.S. PATENT DOCUMENTS

| | | | |
|---|---|---|---|
| 3,856,513 | 12/1974 | Chen et al. | 75/123 B |
| 3,940,293 | 2/1976 | Polk et al. | 75/122 |
| 4,038,073 | 7/1977 | O'Handley et al. | 75/170 |
| 4,052,201 | 10/1977 | Polk et al. | 75/170 |
| 4,126,287 | 11/1978 | Mendlesohn et al. | 75/123 B |

OTHER PUBLICATIONS

Hoselitz, "Magnetization of Fe-Si-B Metallic Glasses", Phys. Stat. Sol., 44a, (1977) K. 191.

Hoselitz, "Magnetic Fe-Si-B Metallic Glasses", Int.$^{n}$. . Conf. . . Quenched Metal III, ed. B. Cantor, (The Metals Society, London, vol. 2, 1978, p. 245).

Egami et al., "Amorphous Alloys as Soft Magnetic Materials", Magnetism & Magnetic Materials-1974, AIP, 1975, pp. 697-701.

*Primary Examiner*—L. Dewayne Rutledge

*Assistant Examiner*—Upendra Roy

*Attorney, Agent, or Firm*—Leo I. MaLossi; James C. Davis, Jr.

[57] ABSTRACT

Iron-boron-silicon ternary amorphous alloys having high saturation magnetization, high crystallization temperature and low coercivity are provided.

5 Claims, 4 Drawing Figures

Fe - B - Si
SATURATION MAGNETIZATION
emu/g
AT ROOM TEMP.
SILICON, a/o
BORON, a/o
IRON, a/o
0
5
10
15
20
25
75
80
85
90
160
165
168
170
172
174
176
178
180

SILICON ATOMIC PERCENT
BORON ATOMIC PERCENT
IRON ATOMIC PERCENT
0
5
10
15
15
20
25
90
85
80
75
0.01
0.02
0.02
0.03
0.03
0.04
0.04
0.05
0.06
0.4
0.7
Fe-B-Si
INTRINSIC COERCIVITY
$H_c$, Oe
ANNEALED

Fe-B-Si
CRYSTALLIZATION, °C
2 hour anneals
SILICON ATOMIC PERCENT
BORON ATOMIC PERCENT
IRON ATOMIC PERCENT
0
5
10
15
15
20
25
90
85
80
75
230
280
290
300
310
320
330
340
350
360
380
410

IRON-BORON-SILICON TERNARY AMORPHOUS ALLOYS

The Government has rights in this invention pursuant to Contract No. N00014-76-C-0807 awarded by the Office of Naval Research, Department of the Navy.

This application is a continuation-in-part of U.S. application Ser. No. 36,197 filed May 4, 1979 and its parent application Ser. No. 898,482 filed Apr. 20, 1978, now abandoned, having been copending with both of the latter applications.

The present invention relates generally to the metal alloy art and is more particularly concerned with novel amorphous metal alloys having a unique combination of magnetic and physical properties, and is further concerned with ribbons and other useful articles made therefrom.

BACKGROUND OF THE INVENTION

While it has been recognized by those skilled in the art that amorphous metals with high saturation magnetization might be used to advantage in electrical apparatus such as distribution and power transformers, such alloys are lacking in necessary ductility and stability for this purpose. Thus, the iron-rich alloy $Fe_{80}B_{20}$ has a $4\pi M_s$ of approximately 16,000 Gauss but begins to crystallize within two hours at about 325° C. and is quite difficult to produce in ductile ribbon form for electrical machinery apparatus. Other amorphous alloys known heretofore have somewhat greater stability and adequate ductility for this purpose, but their saturation magnetization is too low.

SUMMARY OF THE INVENTION

This invention is based upon the discovery that a very narrow range of iron, boron and silicon amorphous alloys have both the desired magnetization and other properties for superior performance in electrical apparatus such as motors and transformers. Consequently it is now possible by means of this invention to provide an amorphous metal in the form of a ribbon sufficiently ductile to be readily used in electrical apparatus construction which has good magnetic properties and elevated temperature stability.

DETAILED DESCRIPTION OF THE INVENTION

Figure 1:
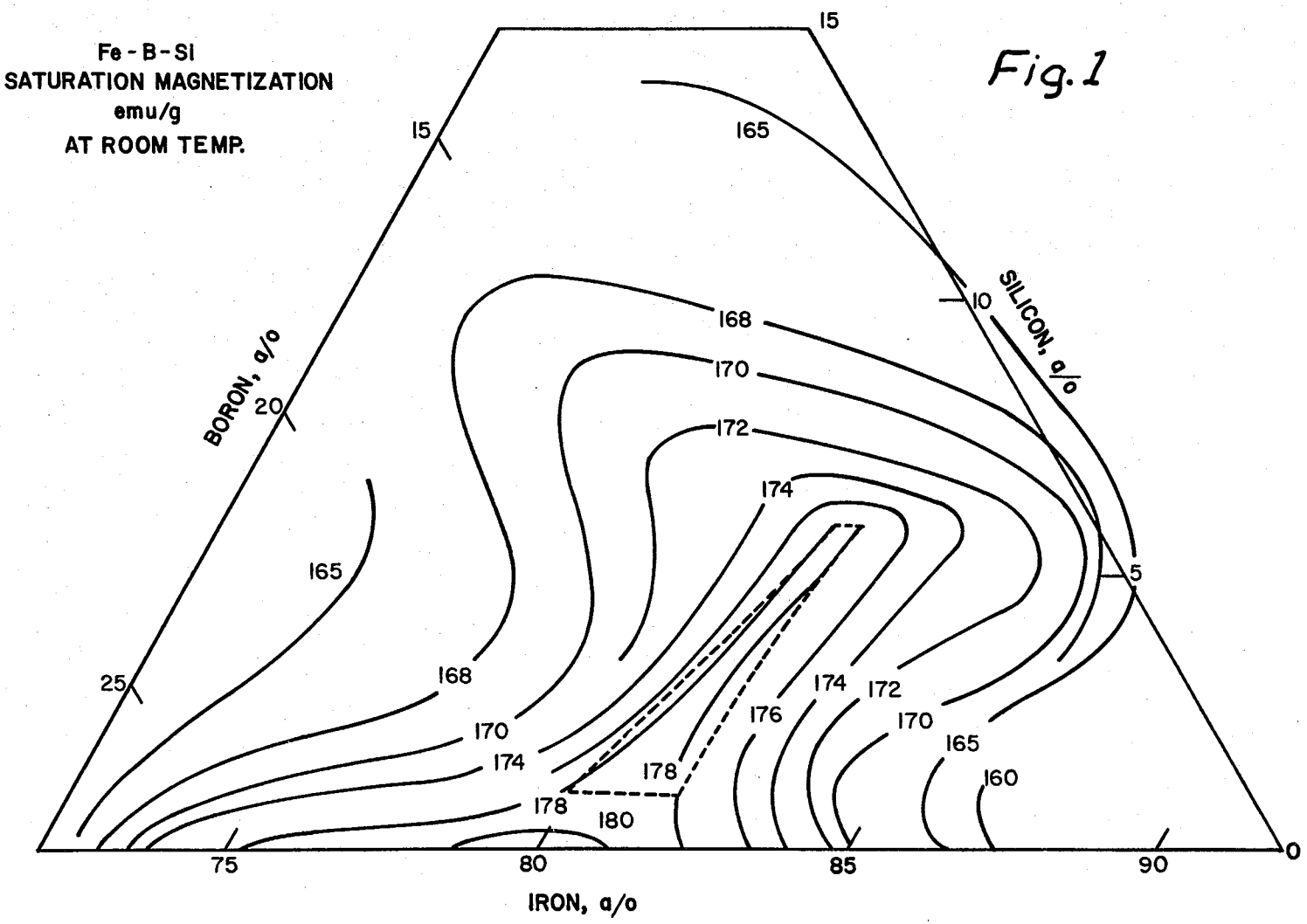
FIG. 1 is a ternary diagram plotting saturation magnetization for a variety of iron, boron and silicon alloys at room temperature (30° C.)

Referring now to the drawings and particularly FIG. 1 it can be seen that a superior group of alloys is formed from all alloys of iron, boron and silicon within the broken lines, i.e. of from 80 atom percent iron, 19 atom percent boron and 1 atom percent silicon to 81¾ atom percent iron, 17¼ atom percent boron and 1 atom percent silicon to 81¾ atom percent iron, 12¼ atom percent boron and 6 atom percent silicon to 82¼ atom percent iron, 11¾ atom percent boron and 6 atom percent silicon. However, this designation includes only part of the spectrum of iron-boron-silicon amorphous metal alloys exhibiting the unique confluence of properties comprising this invention. This complete spectrum is described hereinafter in connection with FIG. 4.

In FIG. 1 saturation magnetizations are plotted for a variety of amorphous alloys. Magnetizations at room temperature and below were determined on small weighed specimens in a vibrating sample magnetometer to a maximum field of 20KOe. Results were extrapolated to $H=\infty$ using a $1/H^2$ function. Values above room temperature were obtained from the relative magnetization curves normalized to the value of magnetization at room temperature. From an examination of the diagram it can be seen that the alloys of the invention have a desirable saturation magnetization of 178 emu/g at room temperature (30° C.).

Figure 2:
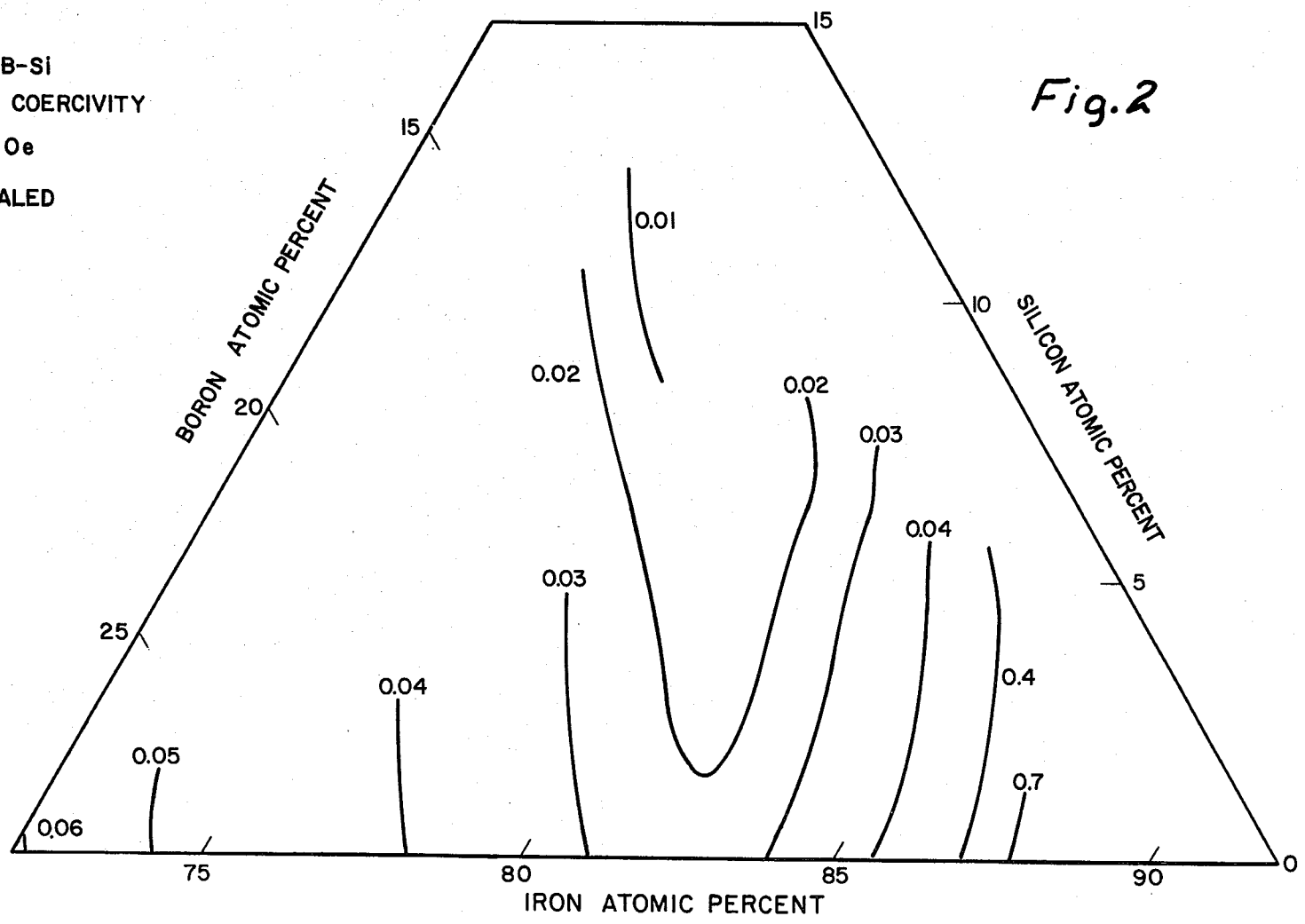
FIG. 2 is a ternary diagram plotting coercivity for a variety of iron, boron and silicon alloys.

In FIG. 2 the intrinsic coercivity is plotted for a number of iron-boron-silicon alloys which was determined on 10 cm. long ribbons set into a 20 cm. long solenoid which was then annealed for 120 min. at a few degrees centrigrade below the crystallization temperatures shown in FIG. 3. A small sense coil was connected to an integrating flux meter and the magnetization vs field was then displayed on an X-Y recorder as the field was slowly varied. From an examination of the diagram it can be seen that the lowest coercivity of 0.02 Oe is found with the alloys having the desirable high saturation magnetization of 178 emu/g reported in FIG. 1.

Figure 3:
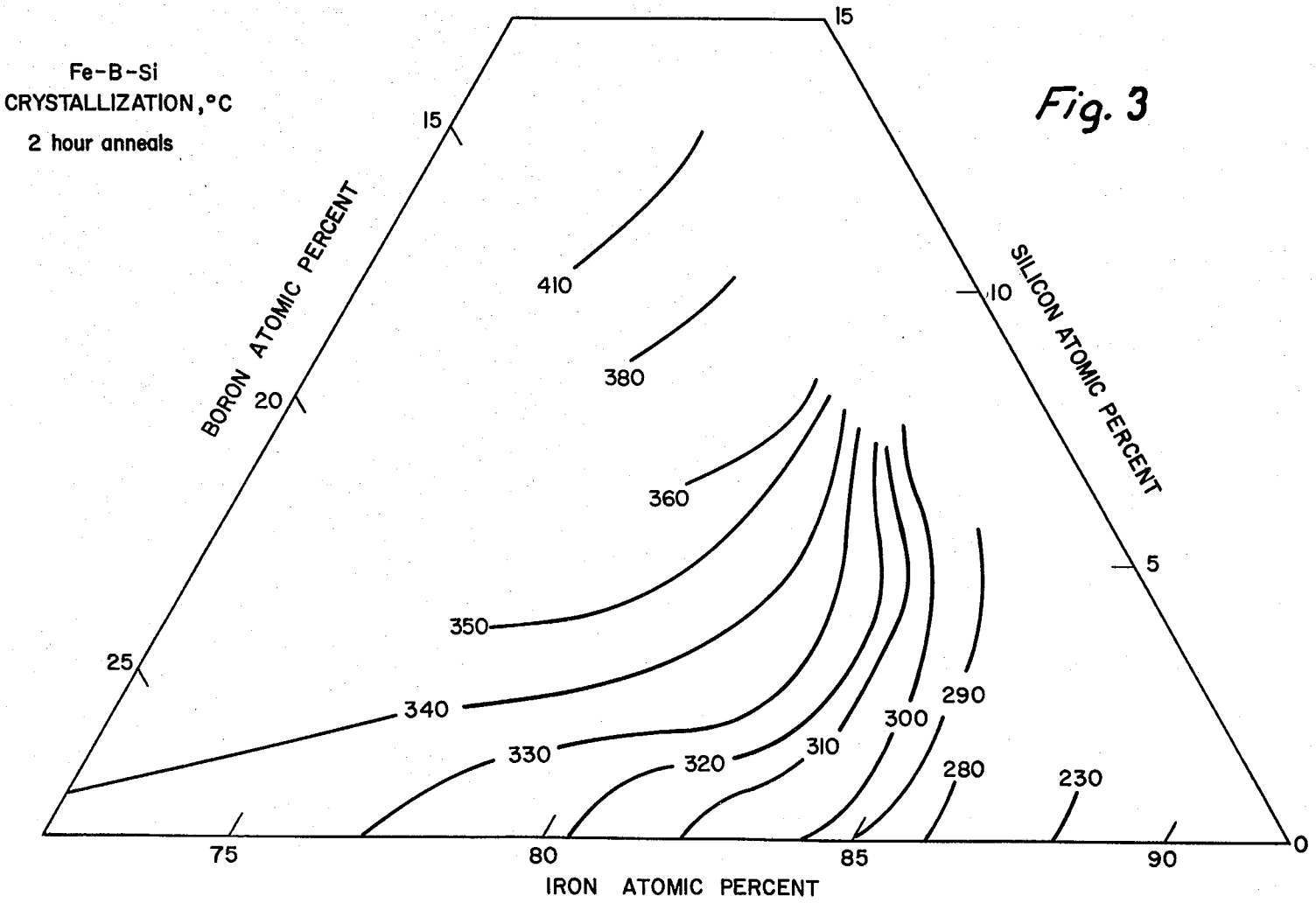
FIG. 3 is a ternary diagram plotting the crystallization temperature for said alloys.

In FIG. 3 crystallization temperatures are reported as determined by noting the temperature at which the coercivity starts to increase after 2 hour exposures at increasing temperature. From an examination of the diagrams it can be seen that the alloys found to have high saturation magnetization and low coercivity are also found to have acceptably high crystallization temperatures. Crystallization temperatures up to 340° C. are obtained for the 6 percent silicon alloys compared to 310°–315° C. for the $Fe_{82}B_{18}$ alloy. This is desirable as it permits the alloy to be annealed to relieve the stresses and reduce the initial high coercive field without permitting the amorphous alloy to crystallize and lose its desirable magnetic qualities. Thus with the alloys of the invention it is possible to anneal above about 320° C. without crystallization occurring.

Figure 4:
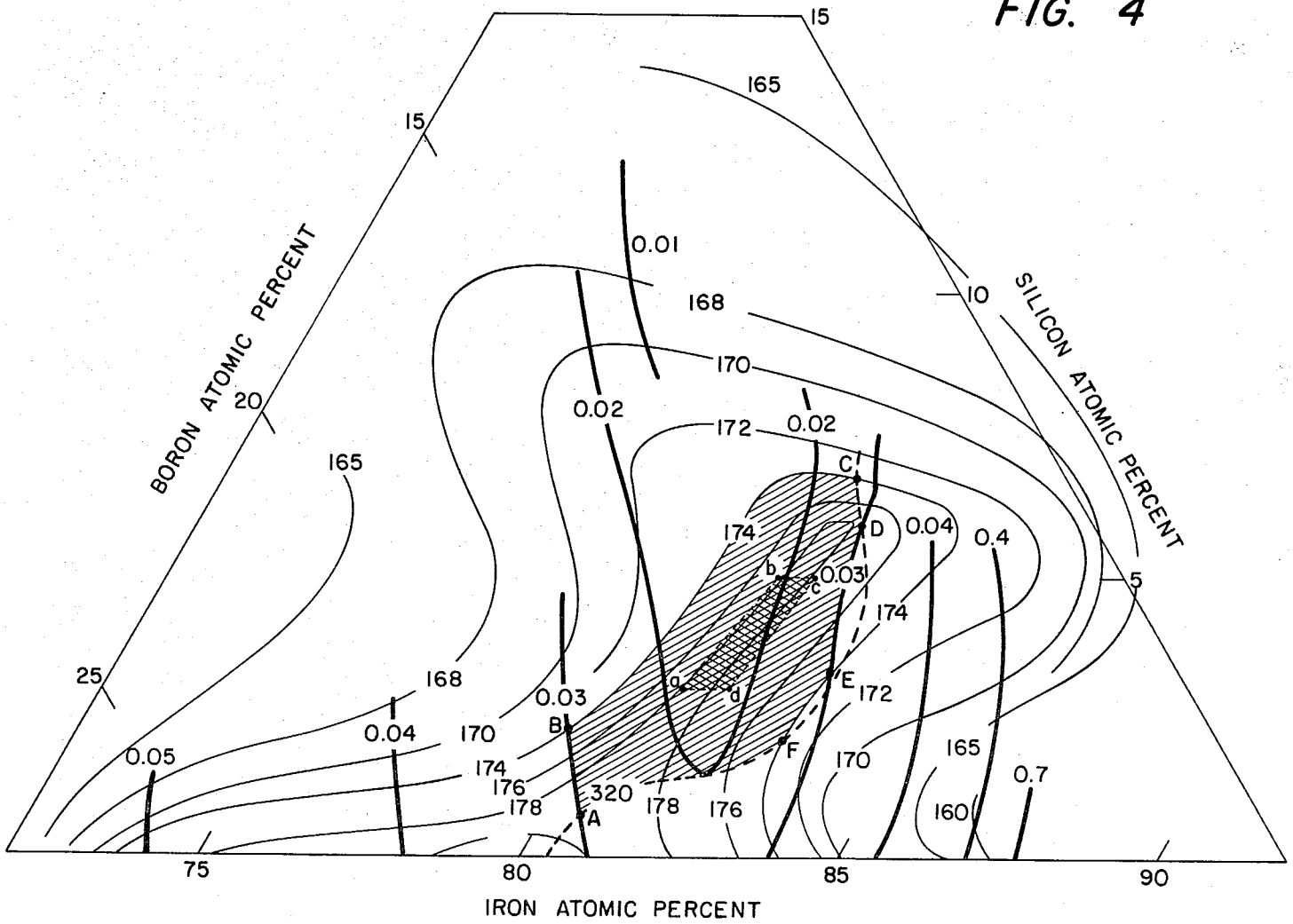
FIG. 4 is a composite of the saturation magnetization contour lines of FIG. 1 and the coercivity contour lines of FIG. 2 with the 320° C. contour line from FIG. 3 superimposed thereon. Shaded region A, B, C, D, E, F, A designates those iron-boron-silicon ternary amorphous metal alloy compositions simultaneously exhibiting the properties of saturation magnetization of at least about 174 emu/g at about 30° C., intrinsic coercivity after annealing of less than about 0.03 oersteds and crystallization temperature of at least about 320° C.

FIG. 4 presents a composite of the gradient lines of FIGS. 1 and 2 with the 320° C. contour line of FIG. 3 added thereto. It is this unification of data, which focuses on the discovery whereby for the first time those amorphous alloys of the iron-boron-silicon system have been identified in which there is a confluence of the properties of high room temperature saturation magnetization, high crystallization temperature and low coercivity. As can be seen from FIG. 1, there is a sharp increase in the steepness of the gradient of the saturation magnetization contour lines from the value of 174 emu/g to higher values. It was never previously recognized that amorphous alloys in this system could be found with the unusual combination of properties of saturation magnetization at room temperature (i.e. about 30° C.) of at least about 174 emu/g, intrinsic coercivity of less than about 0.03 oersteds and crystallization temperature of at least about 320° C. Alloys exhibiting this unusual collection of properties are found in the shaded area bounded by the gradient lines of coercivity, saturation magnetization and crystallization temperature whose intersections are labeled A, B, C, D, E, F. Even more effective alloy compositions are located in the area designated a, b, c, d defined by the compositions 81 atom percent iron, 16 atom percent boron and 3 atom percent silicon (point a); 81¾ atom percent iron, 15¼ atom percent boron and 3 atom percent silicon (point d); 81½ atom percent iron, 13½ atom percent boron and 5 atom percent silicon (point b), and 82 atom percent iron, 13 atom percent boron and 5 atom percent silicon. $Fe_{81.3}B_{15.7}Si_3$ and $Fe_{81.7}B_{13.3}Si_5$ as well as the optimum composition, which has an iron content of 81½ atom percent, a boron content of 14½ atom percent and a silicon content of 4 atom percent are part of area a, b, c, d.

In practicing this invention, novel alloys defined above and claimed herein are prepared suitably by mixing together the alloy constituents in the required proportions in the form of powders and then melting the mixture to provide molten alloy for casting to ribbon of the desired dimensions. The casting operation is preferably carried out through the use of the method disclosed and claimed in copending application Ser. No. 885,436, filed Mar. 10, 1978 and now abandoned, in the name of John L. Walter and assigned to the assignee hereof. The apparatus described in that application as implementing the therein-claimed method may likewise be used to provide long lengths of ribbon of this invention of uniform width and thickness and smooth edges and surfaces. Cooling is carried out in the casting operation at a rate sufficient to produce amorphous material.

While variations in melting point temperatures between alloys of this invention may impose requirements which vary with respect to alloy melting and casting operations, the preparation and processing of these alloys can be carried out with uniformly satisfactory results by following the above procedure and using the described equipment. In other words, the results of this invention are reproducible in a substantially routine manner so long as the compositional limitations stated above and in the appended claims are strictly observed in the preparation of the alloys.

Ribbons of amorphous alloys claimed herein and having the properties detailed in FIGS. 1, 2 and 3 are made by directing a stream of the alloy onto the surface of a rapidly revolving chill roll or drum as described in EXAMPLE 1 of co-pending patent application Ser. No. 885,436 noted above. A typical ribbon has a thickness of 0.0025 cm and is 0.13 cm. wide. The amorphous nature of the resulting ribbon is confirmed by X-ray diffraction, differential scanning calorimetry, and by magnetic and physical property measurements. When the segments are annealed in purified nitrogen for two hours at temperatures ranging from 100° C. to 400° C. the crystallization temperature is taken as that temperature, for the 2-hr. anneal, at which the coercive force abruptly increases.

To prepare a transformer or motor stator, strips of the aforesaid alloy about ½" wide and 2 mils thick can be coated with a binder such as a polyamide-imide and the strips placed 6 layers deep in a non-magnetic die cavity of stainless steel lined with Teflon-coated aluminum with alternating layers at 90°. The strips are held in place by means of permanent magnets placed under the die and the composite pressed at 2000 psi and 330° C. for 2 minutes after allowing the die to preheat to 330° C. for a few minutes without pressure to equilibrate and drive out excessive air and water from the die and ribbon. The composite is then annealed at 325° C. for 2 hours and found to have a low coercive force and high saturation magnetization.

Other composites are formed with or without a binder with similar results. Other suitable binders include the epoxies, polyamide-imides, cyanoacrylates, and phenolics. The binder should have a coefficient of thermal expansion compatible with the metal ribbon, be electrically insulating, cure rapidly and be able to meet the thermal requirements of the intended application and annealing if required. In some applications there are further requirements such as being compatible with commercial refrigerants when used for air conditioning compressor motors. The above method for preparing a stator is described and claimed in copending, commonly-assigned application Ser. No. 961,261 filed Nov. 16, 1978 in the name of J. H. Lupinski and is not the invention of the applicants herein.

To prepare a wound-type transformer the amorphous metal foil, with widths, for example, up to 6 inches wide, may be wound on a mandrel with a circular or rectangular cross-section. The number of turns wound onto the mandrel, and the width of the tape, will depend on the transformer rating.

It will be understood by those skilled in the art that slight but obvious modifications can be made which will fall within the scope of the invention such as, for example, an article of manufacture claimed herein may contain a minor amount of crystalline material which will not seriously impair its desirable properties. Accordingly, depending upon the particular article of manufacture and its intended use the article may contain up to 10% of crystalline material. Consequently the application is intended to be limited only by the appended claims.

I claim as my invention:

1. An iron-boron-silicon amorphous metal alloy simultaneously having values of saturation magnetization at about 30° C. of at least about 174 emu/g, intrinsic coercivity of less than about 0.03 oersteds and crystallization temperature of at least about 320° C., said alloy consisting essentially of iron, boron and silicon and having a composition in the region A, B, C, D, E, F, A of FIG. 4.

2. The alloy of claim 1 further defined as being of a composition in the area of the iron-boron-silicon ternary diagram defined by the compositions 81 atom percent iron, 16 atom percent boron and 3 atom percent silicon; 81¾ atom percent iron, 15¼ atom percent boron and 3 atom percent silicon; 81½ atom percent iron, 13½ atom percent boron and 5 atom percent silicon, and 82 atom percent iron, 13 atom percent boron and 5 atom percent silicon.

3. The alloy of claim 1 of the formula $Fe_{81.3}B_{15.7}Si_3$.

4. The alloy of claim 1 of the formula $Fe_{81.5}B_{14.5}Si_4$.

5. The alloy of claim 1 of the formula $Fe_{81.7}B_{13.3}Si_5$.

* * * * *